US011085208B1

(12) United States Patent
Walterscheid

(10) Patent No.: US 11,085,208 B1
(45) Date of Patent: Aug. 10, 2021

(54) MODULAR ELECTRICAL SAFETY ASSEMBLY

(71) Applicant: David Walterscheid, Argyle, TX (US)

(72) Inventor: David Walterscheid, Argyle, TX (US)

( * ) Notice: Subject to any disclaimer, the term of this patent is extended or adjusted under 35 U.S.C. 154(b) by 335 days.

(21) Appl. No.: 16/351,501

(22) Filed: Mar. 12, 2019

(51) Int. Cl.
*E05B 67/38* (2006.01)
*H01F 7/06* (2006.01)
*E05B 13/00* (2006.01)

(52) U.S. Cl.
CPC ..... *E05B 67/383* (2013.01); *E05B 13/002* (2013.01); *H01F 7/06* (2013.01)

(58) Field of Classification Search
CPC ..... E05B 67/383; E05B 13/002; E05B 67/38; E05B 13/001; E05B 47/0038; H01F 7/06
USPC ..... 70/276.413, DIG. 30; 292/251.5; 200/43.11, 43.15, 43.19, 43.21, 43.22
See application file for complete search history.

(56) References Cited

U.S. PATENT DOCUMENTS 2,134,922 A * 11/1938 Laing ..... E05B 13/001 70/428
5,077,452 A * 12/1991 Mathers ..... H01H 9/287 200/43.01
5,468,925 A * 11/1995 Mohsen ..... H01H 9/283 200/43.11
6,053,018 A * 4/2000 Ramsauer ..... E05B 17/22 109/44
10,087,656 B1 * 10/2018 Cannella ..... E05B 63/0004
2007/0028656 A1 * 2/2007 Jospe ..... E05C 1/14 70/210
2012/0186953 A1 * 7/2012 Furukawa ..... H01H 9/281 200/43.21
2013/0270076 A1 * 10/2013 Linden ..... H01H 9/283 200/43.15

* cited by examiner

*Primary Examiner* — Lloyd A Gall
(74) *Attorney, Agent, or Firm* — Law Office of Jeff Williams PLLC; J. Oliver Williams

(57) ABSTRACT

A modular electrical safety assembly for use with a control device of an electrical equipment includes a magnet housing with a magnet, an equipment cover, and a slider. The magnet housing includes a magnet to selectively couple to the electrical equipment. The magnet induces an attraction force on the electrical equipment. The equipment cover is coupled to the magnet housing and configured to prevent operation of the control device. The slider is configured to translate along a surface of the equipment cover between a first position and a second position. In the first position it prevents a change in polarity of the magnet. In the second position it permits a change in polarity of the magnet. The slider and equipment cover lock together to selectively restrict translation of the slider.

20 Claims, 10 Drawing Sheets

MODULAR ELECTRICAL SAFETY ASSEMBLY

BACKGROUND

1. Field of the Invention

The present application relates to an electrical safety assembly, and more particularly to an assembly that provides electrical equipment service personnel a means to temporarily lock-out/tag-out a piece of electrical equipment without requiring any modifications to the electrical equipment or enclosure.

2. Description of Related Art

Proper lockout/tagout practices and procedures safeguard workers from the release of hazardous energy and typically involve the locking and tagging of energy equipment to isolate that equipment from use, and otherwise prevent its use when unsafe or if the equipment is being serviced. These can include placing a tag on the equipment to signify to others that work is being done. This still permits for operation of the equipment in the case when someone fails to see or heed the tag, however. Personnel may modify the equipment to accept lock-out/tag-out provisions which could result in equipment damage or downtime. Additionally, personnel can replace the lacking equipment with equipment which has lock-out/tag-out provisions installed, however, this costs considerable time and money. Currently, electrical equipment service personnel are limited in their options when performing lock-out/tag-out operations on equipment without previously installed lock-out/tag-out provisions.

For example, circuit breakers may be placed in the off position and the circuit breaker cabinet locked against use until the associated equipment may be safely placed back into service. However, certain control switches for medium and high voltage circuit breakers, such as those having pistol grip handles, cannot be safely locked into the off position and properly tagged as the switches lack any locking mechanism. Many types of lock attachments have been developed but they appear limited to specific models only, or require physical modifications to equipment. Furthermore, the prior art has attempted to provide handle lock attachments that are mounted directly to the equipment thereby necessitating equipment modification.

Although strides have been made to provide improved lock-out/tag-out devices and practices, considerable shortcomings remain. It is desired that an assembly be provided that to gives electrical equipment service personnel a means to temporarily lock-out/tag-out a piece of electrical equipment without requiring any modifications to the electrical equipment or enclosure.

SUMMARY OF THE INVENTION

It is an object of the present application to provide an assembly that provided that gives electrical equipment service personnel a means to temporarily lock-out/tag-out a piece of electrical equipment without requiring any modifications to the electrical equipment or enclosure. The assembly may take many forms depending on the type, style, size, vintage, or make of equipment being locked-out (i.e. pushbuttons, control switches, circuit breaker operators, etc.) but each assembly will consist of at least a switchable magnet housing, a sliding handle block (i.e. slider), and an equipment cover/slide cover.

It is a further object of the present application that the assembly uses a magnetic force to releasably secure the assembly to the electrical equipment, rather than having a permanently mounted device installed onto the equipment. Additionally, the assembly will surround and/or cover the equipment switch, button, breaker, and so forth to prevent operation during servicing.

It is an object of the present application to provide an assembly that is not permanently mounted to the electrical equipment and may be installed and used on multiple pieces of the same type of electrical equipment quickly and easily. Additionally, it is desired that the assembly does not require any special modifications to the electrical equipment or enclosure to which it is attached.

Ultimately the invention may take many embodiments. In these ways, the present invention overcomes the disadvantages inherent in the prior art. The more important features have thus been outlined in order that the more detailed description that follows may be better understood and to ensure that the present contribution to the art is appreciated. Additional features will be described hereinafter and will form the subject matter of the claims that follow.

Many objects of the present application will appear from the following description and appended claims, reference being made to the accompanying drawings forming a part of this specification wherein like reference characters designate corresponding parts in the several views.

Before explaining at least one embodiment of the present invention in detail, it is to be understood that the embodiments are not limited in its application to the details of construction and the arrangements of the components set forth in the following description or illustrated in the drawings. The embodiments are capable of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present design. It is important, therefore, that the claims be regarded as including such equivalent constructions insofar as they do not depart from the spirit and scope of the present application.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
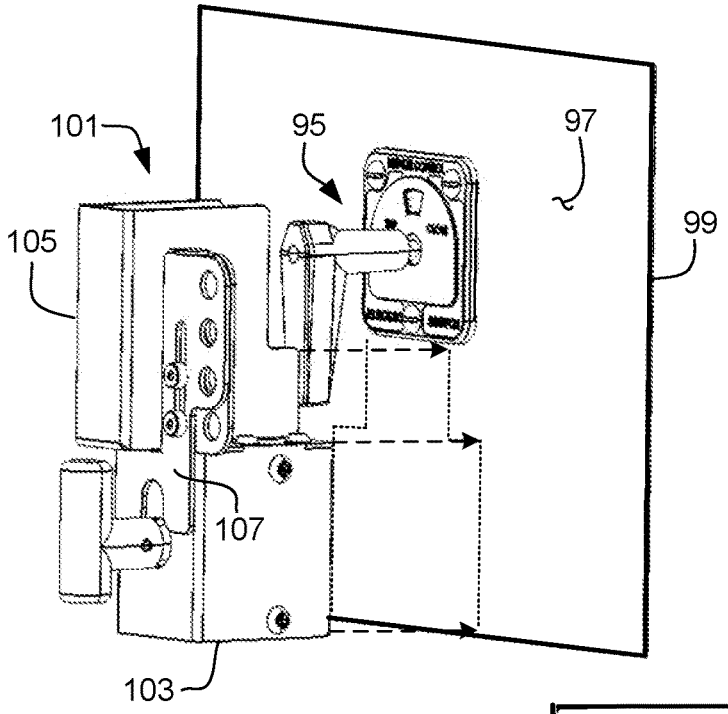
FIG. 1 is a perspective view of a modular electrical safety assembly according to an embodiment of the present application.

While the embodiments and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the embodiments described herein may be oriented in any desired direction.

The embodiments and method in accordance with the present application overcomes one or more of the above-discussed problems commonly associated with elevated platforms discussed previously. In particular, the assembly of the present application provides electrical equipment service personnel a means to temporarily lock-out/tag-out a piece of electrical equipment without requiring any modifications to the electrical equipment or enclosure. The assembly uses magnetic attraction forces to couple to the electrical equipment. A portion of the assembly surrounds parts of the control device to restrict activation of the control device. The assembly is lockable by restricting adjustment of the magnet. These and other unique features are discussed below and illustrated in the accompanying drawings.

The embodiments and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments and method of the present application is illustrated in the associated drawings. The modular electrical safety assembly for use with a control device of an electrical equipment includes a magnet housing with a magnet, an equipment cover, and a slider. The magnet housing includes a magnet to selectively couple to the electrical equipment via a magnetic attraction force. The magnet induces the attraction force on the electrical equipment. The equipment cover is coupled to the magnet housing and configured to prevent operation of the control device. The slider is configured to translate along a surface of the equipment cover between a first position and a second position. In the first position it prevents a change in polarity of the magnet. In the second position it permits a change in polarity of the magnet. The slider and equipment cover lock together to selectively restrict translation of the slider. Additional features and functions are illustrated and discussed below.

Referring now to the Figures wherein like reference characters identify corresponding or similar elements in form and function throughout the several views. The following Figures describe embodiments of the present application and its associated features. With reference now to the Figures, embodiments of the present application are herein described. It should be noted that the articles "a", "an", and "the", as used in this specification, include plural referents unless the content clearly dictates otherwise.

Figure 2:
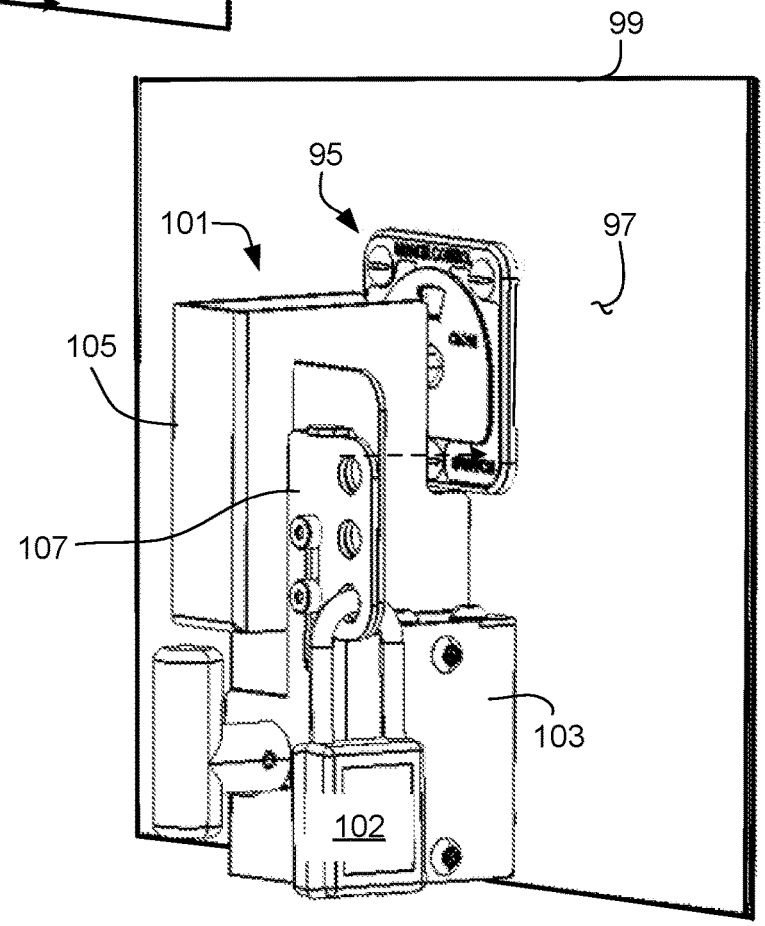
FIG. 2 is an alternate perspective view of the modular electrical safety assembly of FIG. 1.

Referring now to FIGS. 1 and 2 in the drawings, perspective views of a modular electrical safety assembly is illustrated. In FIG. 1, modular electrical safety assembly 101 is shown removed from a surface 97 of an electrical equipment 99. In FIG. 2, assembly 101 is shown coupled to surface 97 via a magnet within assembly 101. Magnetic attraction forces are generated within assembly 101 to facilitate selective coupling to equipment 99. In FIG. 1, assembly 101 is shown in an unlocked configuration while FIG. 2 illustrates assembly 101 in a locked configuration. Lock 102 is passed through aligned holes to prevent translation of the slider. Of note also is that assembly 101 is configured to surround a portion of control device 95 so as to prevent its activation during servicing of equipment 99.

It is understood that many types of methods and devices may be used to accomplish the desired purpose of assembly 101. Assembly 101 may take many forms depending on the type, style, size, vintage, or make of equipment being locked-out (Eg: pushbuttons, control switches, circuit breaker operators, etc) but all units will include a magnet housing 103, an equipment cover 105, and a slider 107.

Figure 3:
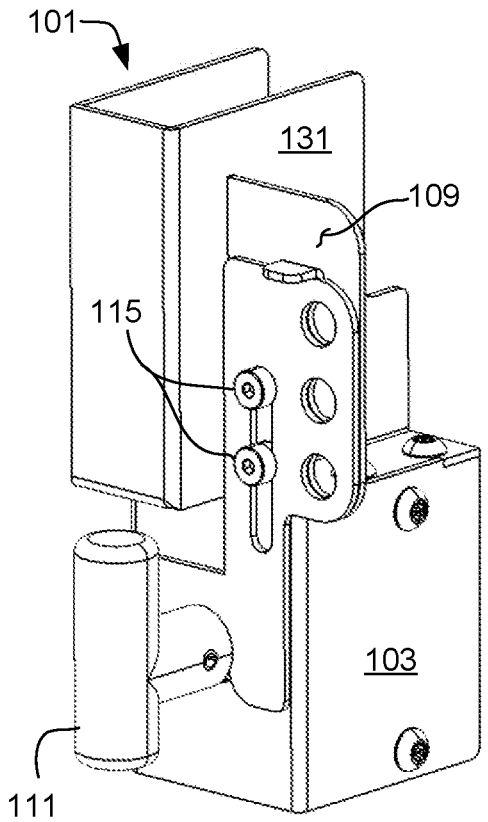
FIG. 3 is an enlarged front perspective view of the modular electrical safety assembly of FIG. 1 in a locked configuration.
Figure 4:
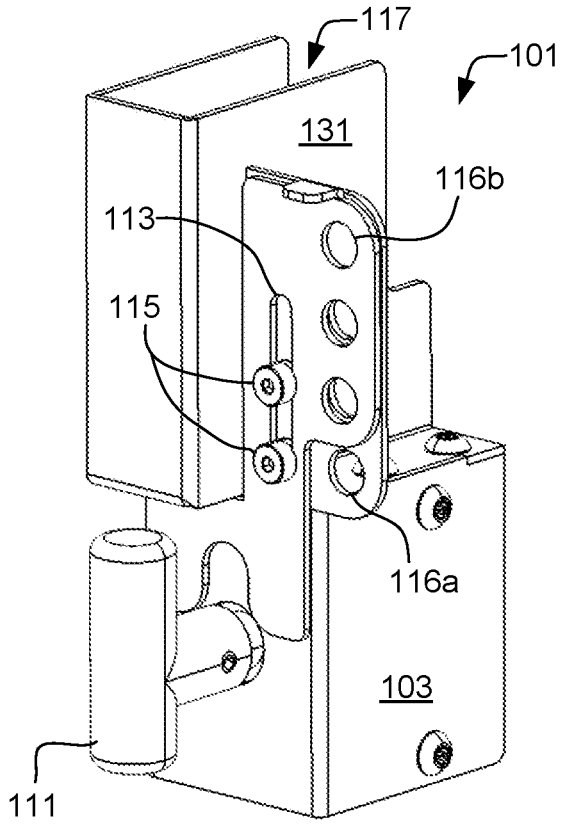
FIG. 4 is an alternate front perspective view of the modular electrical safety assembly of FIG. 3 in an unlocked configuration.
Figure 5:
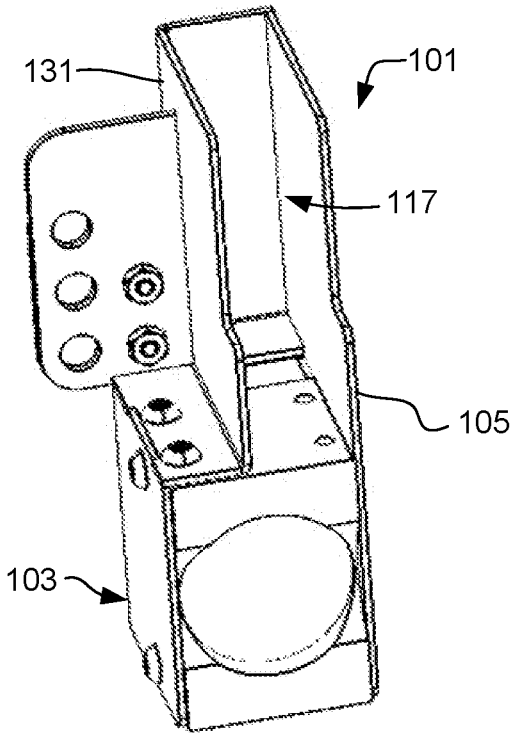
FIG. 5 is a rear perspective view of the modular electrical safety assembly of FIG. 3.
Figure 6:
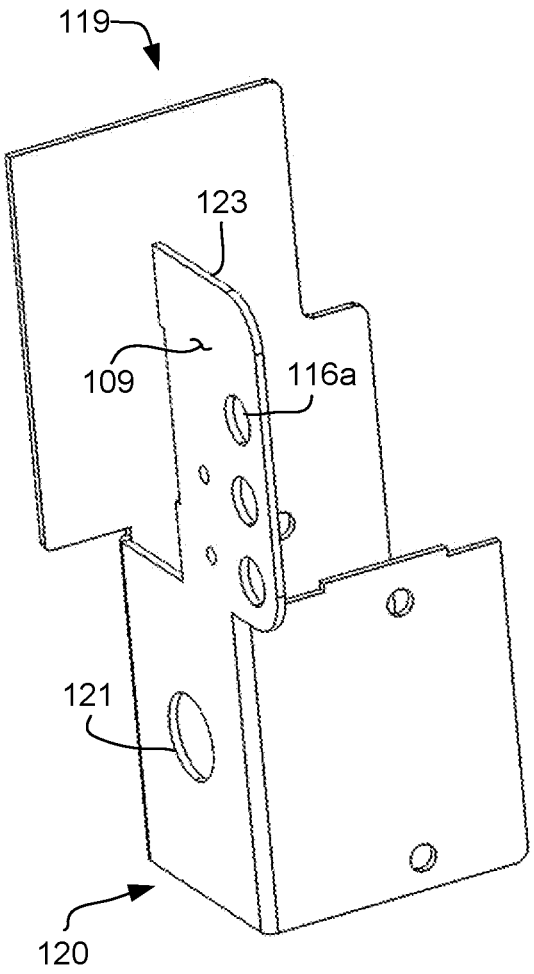
FIG. 6 is a front perspective view of a side cover used in the modular electrical safety assembly of FIG. 3.
Figure 7:
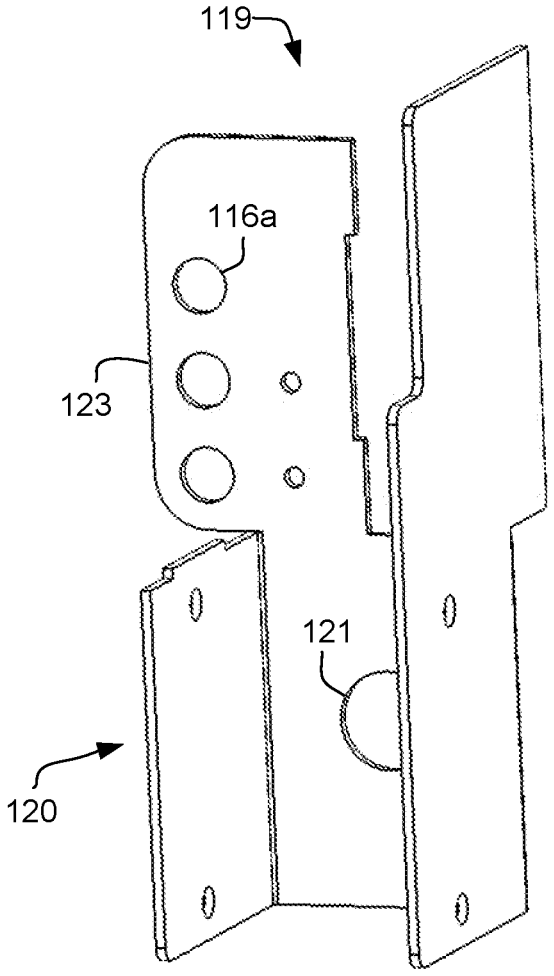
FIG. 7 is a rear perspective view of the side cover of FIG. 6.

Referring now also to FIGS. 3-5 in the drawings, enlarged perspective views of assembly 101 are illustrated. FIGS. 3 and 4 are front perspective views while FIG. 5 is a rear perspective view of assembly 101. FIGS. 3 and 4 are used to show the operation of assembly 101 with slider 107 in two different positions. As seen in FIG. 3, slider 107 is configured to translate along a surface 109 of equipment cover 105 between a first position (see FIG. 3) and a second position (see FIG. 4). In the first position, slider 107 is lowered into contact with handle 111, wherein slider 107 is between a portion of handle 111 and cover 105. In this position, handle 111 is prevented from depressing into magnet housing 103 and rotating. In the second position, slider 107 is raised such that there is no interference in the operation of handle 111.

As seen in the Figures, slider 107 includes a slot 113. Assembly 101 includes a set of fasteners 115 configured to secure slider 107 in relation to surface 109 via the head of the fasteners 115, but to permit translation of fasteners 115 within slot 113. Equipment cover 105 and slider 107 include a plurality of aligned holes 116*a* and 116*b* that are used to facilitate locking of the slider 107 to a particular position, namely either the first and the second positions. Lock 102 passes through holes 116*a* and 116*b*. Of note with FIG. 5 is the internal channel 117 formed within cover 105. As seen in FIG. 1, control device 95 is a pistol grip switch that rotates to turn on and off. Cover 105 surrounds a portion of control device 95 to restrict activation, and in this case, the rotation of control device 95. A second embodiment of assembly 101 will be illustrated with respect to FIGS. 19-28 below. In this embodiment, the control device is a button wherein the equipment cover of the assembly covers the button to prevent depressing it for activation of the electrical equipment.

It is seen that a number of fasteners are used to secure the various parts of assembly 101 together. The fasteners are not meant to be limiting but are exemplary as one method of securing them. Other forms such as interference fit, adhesives, and the sort may also be used.

Figure 8:
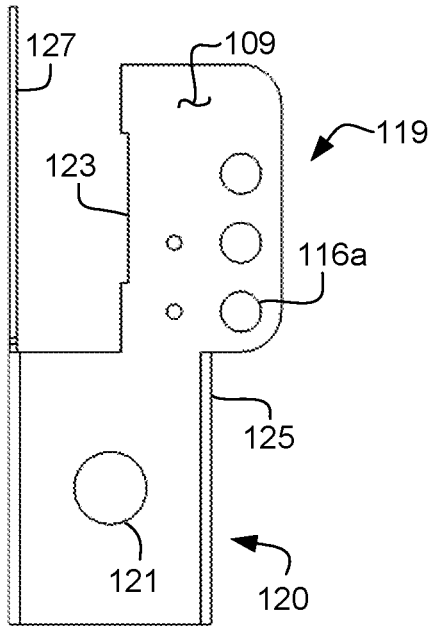
FIGS. 8-12 are views of the side cover of FIG. 6.
Figure 9:
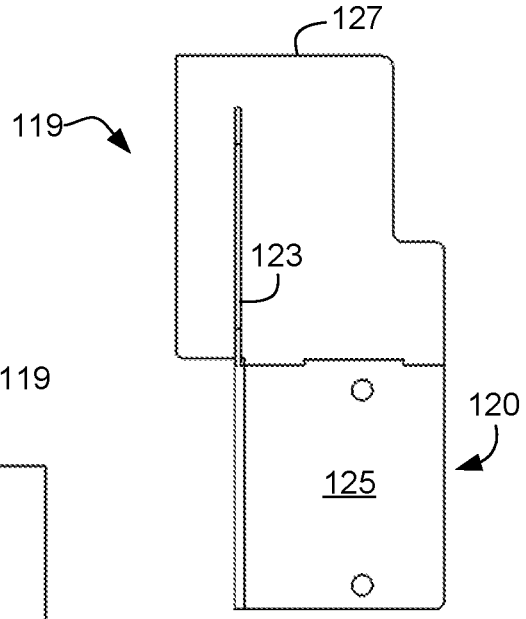
Figure 10:
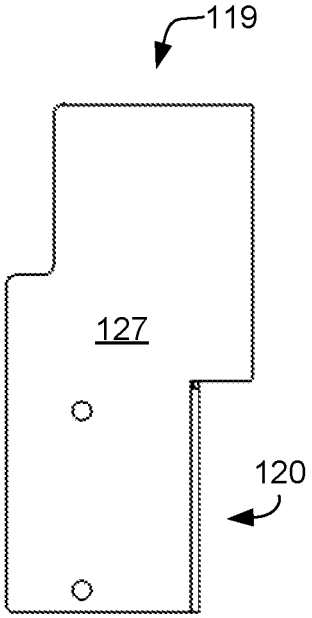
Figure 11:
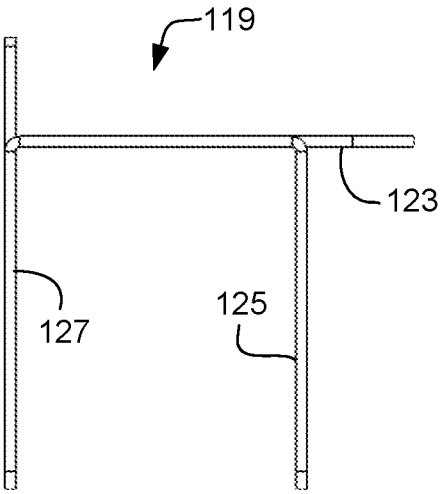
Figure 12:
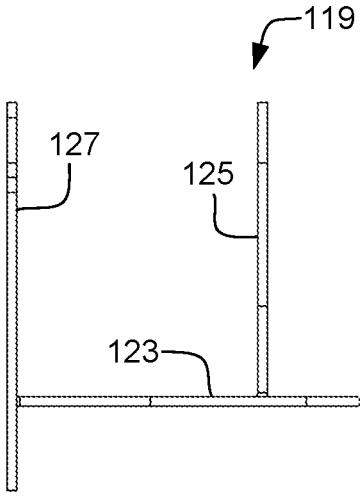

Referring now also to FIGS. 6-12 in the drawings, assorted views of a side cover within cover 105 are illustrated. Cover 105 includes a side cover 119 configured to couple to magnet housing 103. An aperture 121 is located within a lower region 120 to facilitate the operation and passage of handle 111. A front panel 123 extends above lower region 120 and includes a plurality of holes 116*a*. Holes for fasteners 115 are also seen. Lower region 120 includes panels 125 and 127 opposite one another. Panel 125 is below front panel 123 and extends along magnet housing 103 and is approximately the same height as such. Panel 127 extends the full length of assembly 101, above panel 125 to a height above panel 123. A series of holes are seen in lower region 120 for coupling to magnet housing 103 with fasteners. It is understood that the precise heights and dimensions of panels 123, 125, and 127 are not limited as shown. It is required that channel 117 be formed so as to prevent control device 95 to be swung side to side and activated. Different heights of the panels may facilitate such function. For clarity purposes, FIG. 8 is a front view, FIG. 9 is a right side view, FIG. 10 is a left side view, FIG. 11 is a bottom view, and FIG. 12 is a top view.

Figure 13:
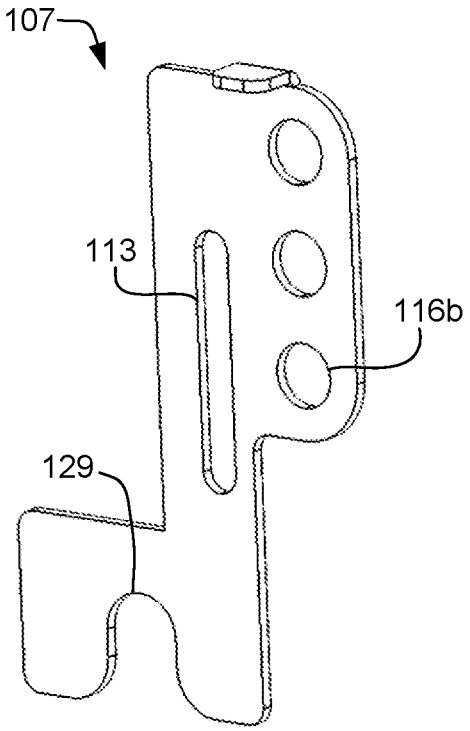
FIGS. 13-14 are views of a slider in the modular electrical safety assembly of FIG. 3.
Figure 14:
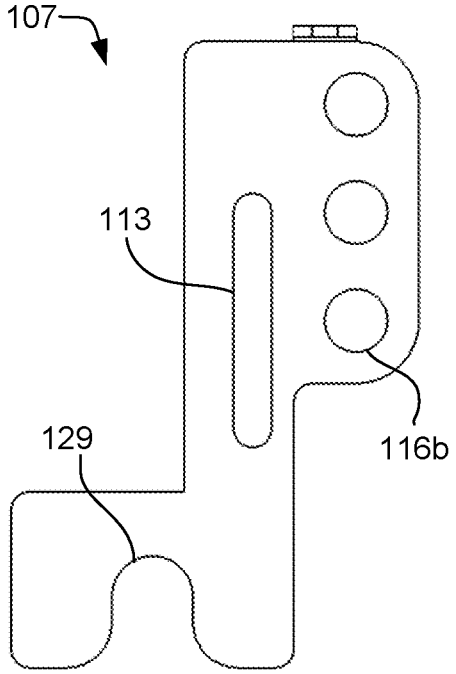

Referring now also to FIGS. 13 and 14 in the drawings, enlarged views of slider 107 are illustrated. Slider 107 includes slot 113 and apertures 116*b* as described previously. Slider 107 is configured to restrict removal of assembly 101 from equipment 99. As assembly 101 uses magnetic attractive forces to create the coupling effect between the two, a manner is provided to selectively release or remove the magnetic attraction force. Handle 111 is used as one method of regulating the attraction force. In this embodiment, handle 111 depresses into magnet housing 103 and initiates a movement of the internal magnet. If handle 111 is prevented from depressing into housing 103, the position of the magnet is prevented from changing. Therefore, if the position of the magnet was such as to induce magnetic attraction forces, such forces would stay active until handle 111 was operated to change it. Likewise, if the position of the magnet was such as to remove magnetic attraction forces, such forces would remain removed until handle 111 was operated to change it. Slider 107 includes a saddle arch 129 configured to translate between handle 111 and lower region 120 to prevent the depression of handle 111 to affect the magnetic attraction forces.

Figure 15:
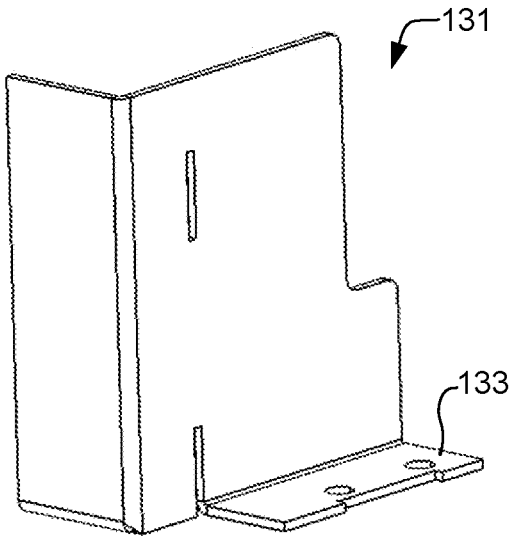
FIG. 15 is a front perspective view of a top cover in the modular electrical safety assembly of FIG. 3.
Figure 16:
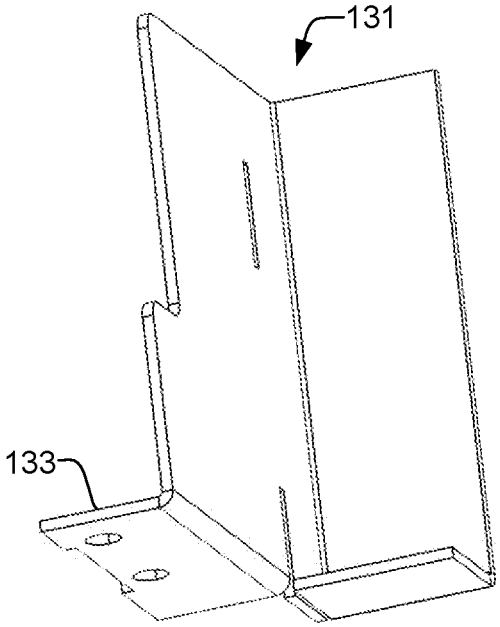
FIG. 16 is a rear lower perspective view of the top cover of FIG. 15.

Referring now also to FIGS. 15 and 16 in the drawings, a top cover 131 of cover 105 is illustrated. FIG. 15 is a front perspective view while FIG. 16 is a lower rear perspective view. Cover 105 also includes a top cover 131 that works with side cover 119 to form channel 117. Top cover 131 has a lower tab 133 with holes for securing to magnet housing 103. From FIGS. 3-5 it is shown that top cover 131 is located above lower region 120 and extends over aperture 121 to panel 127. Control device is prevented from rotating or pulling forward in channel 117.

Figure 17:
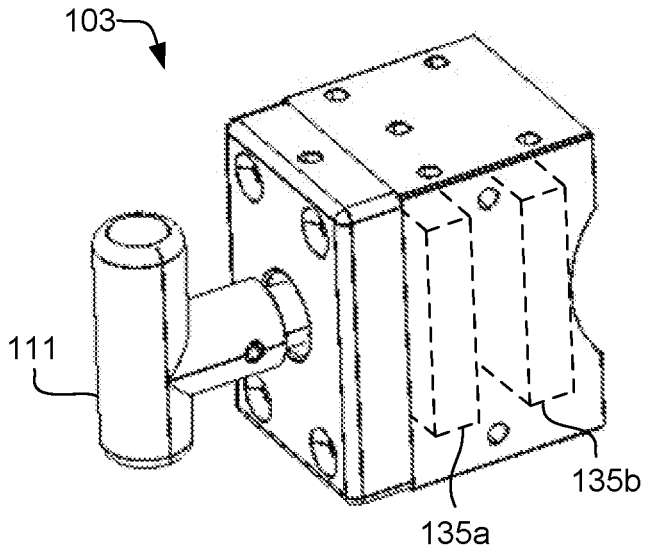
FIGS. 17 and 18 are perspective views of a magnet housing in the modular electrical safety assembly of FIG. 3.
Figure 18:
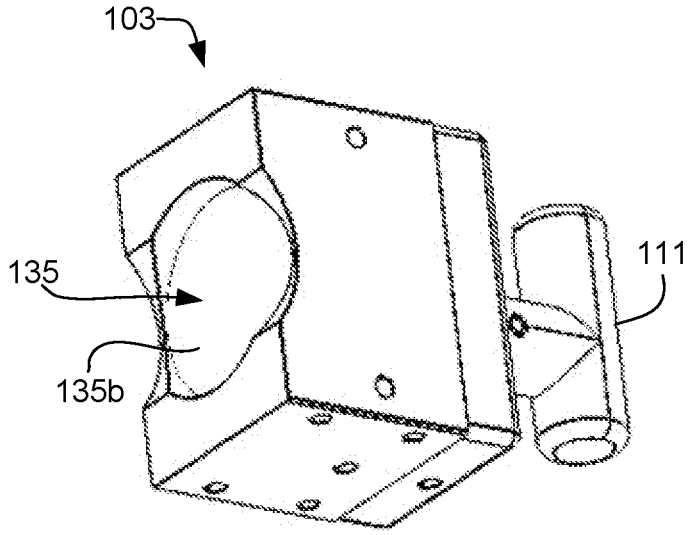

Referring now also to FIGS. 17 and 18 in the drawings, perspective views of magnet housing 103 are illustrated. Assembly 101 is configured to include at least one magnet that, in operation, can adjust polarity so as to selectively activate/initiate/induce the magnetic attractive forces and also remove them. Magnet 135 is seen within housing 103. In operation, the switchable magnet 135 is in a housing 103 with a protruding handle 111 that, when operated 180 degrees, turns the magnet 135 "ON", such that magnetic attraction forces are initiated. The handle 111 operation aligns the poles of two internal magnets 135*a* and 135*b*. One magnet 135*b* is fixed and the other (magnet 135*a*) is attached to the handle 111. The depressing of handle 111 permits handle 111 to rotate. Rotation of handle 111 aligns or misaligns the poles (alternates the polarity) of the magnets relative to one another. To turn off the magnet 135, the handle 111 must be depressed and operated 180 degrees opposite to thereby misaligning the polarity of the magnets 135*a*, 135*b*, so as to remove the magnetic attraction forces.

Figure 19:
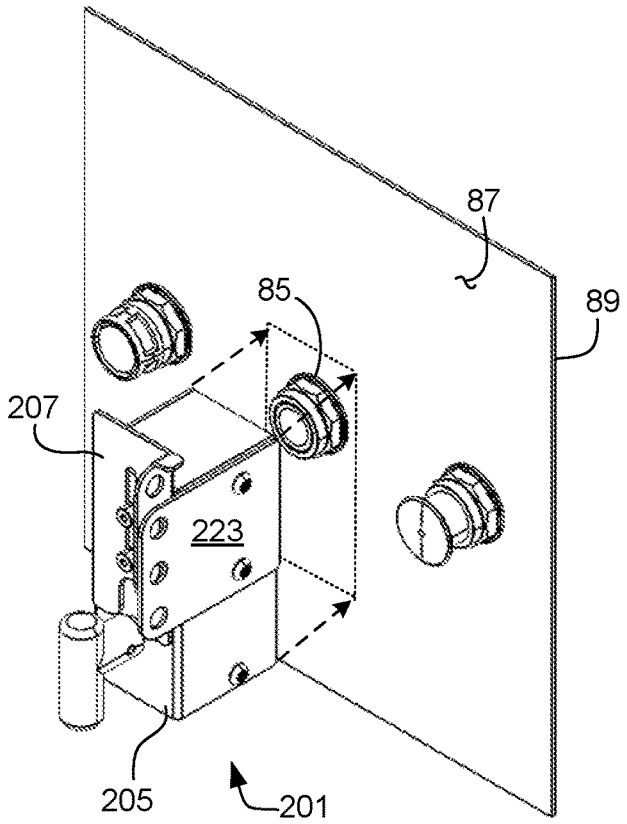
FIGS. 19 and 20 are front perspective views of a secondary embodiment of the modular electrical safety assembly of FIG. 3.
Figure 20:
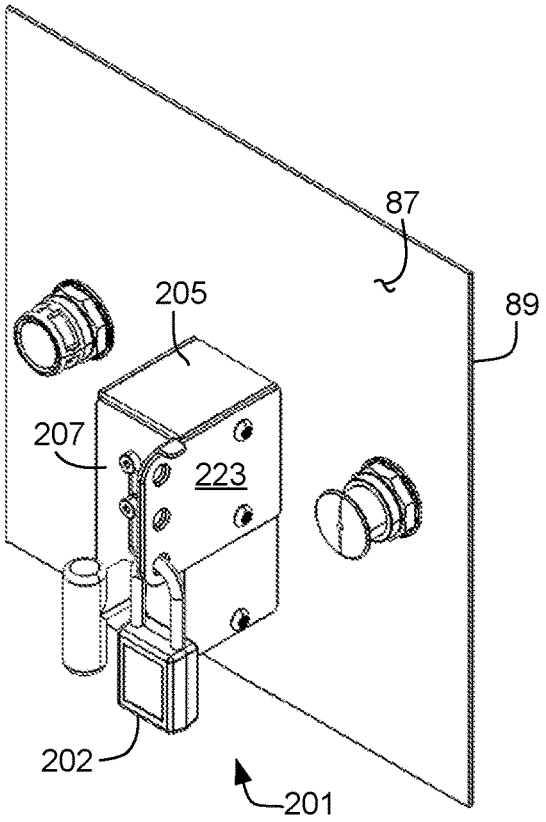

Referring now to FIGS. 19 and 20 in the drawings, perspective views of an alternate embodiment of modular electrical safety assembly 101 is illustrated. In FIG. 19, modular electrical safety assembly 201 is shown. Assembly 201 is similar in form and function to that of assembly 101 above. The variation of assembly 201 compared to that of assembly 101 is to facilitate use with a different type of control device 87. Assembly 201 is shown removed from a surface 87 of an electrical equipment 89. In FIG. 20, assembly 201 is shown coupled to surface 87 via a magnet within assembly 201. Magnetic attraction forces are generated within assembly 201 to facilitate selective coupling to equipment 89. In FIG. 19, assembly 201 is shown in an unlocked configuration while FIG. 20 illustrates assembly 201 in a locked configuration. Lock 202 is passed through aligned holes to prevent translation of the slider. Of note also is that assembly 201 is configured to surround and cover a portion of control device 85 so as to prevent its activation during servicing of equipment 89. In this situation, control device 85 is a push-button device, therefore, device 85 needs to be surrounded and covered to prevent activation of equipment 89.

Figure 21:
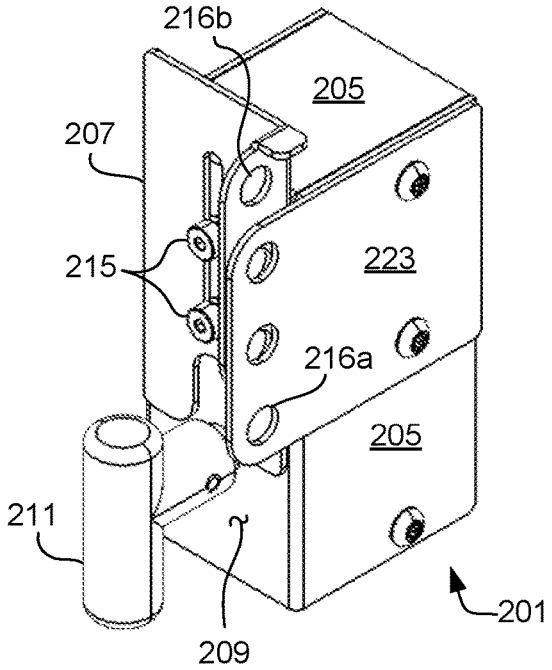
FIG. 21 is an enlarged front perspective view of the modular electrical safety assembly of FIG. 19.
Figure 22:
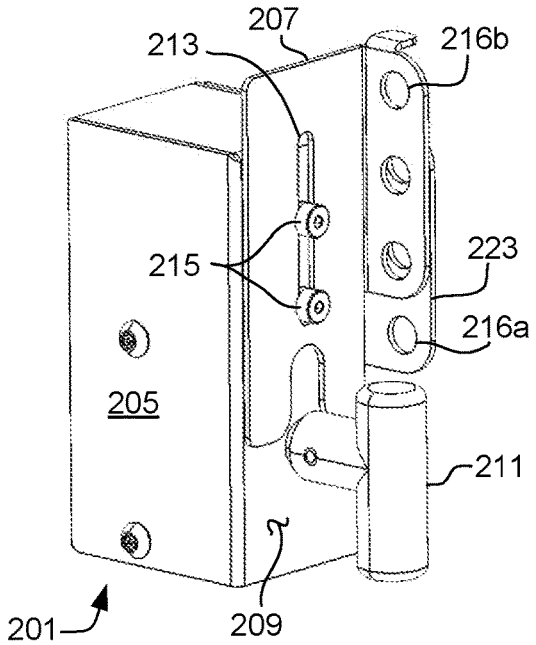
FIG. 22 is an alternate front perspective view of the modular electrical safety assembly of FIG. 21.
Figure 23:
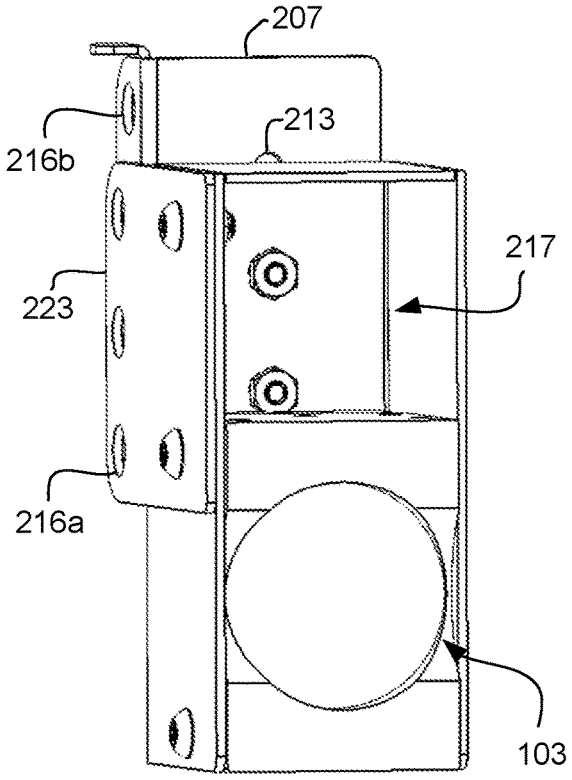
FIG. 23 is a rear perspective view of the modular electrical safety assembly of FIG. 21 in a locked configuration.

Referring now also to FIGS. 21-23 in the drawings, perspective views of assembly 201 are illustrated. Assembly 201 is configured to include magnet housing 103 described above. Magnet 135, 135*a*, 135*b* are equally applicable in operation with assembly 201 as they are with assembly 101. Assembly 201 is configured to operate a slider 207 between a first position and a second position similarly to that of slider 107. Assembly 201 also includes magnet housing 103 and an equipment cover 205. In FIGS. 21-23, slider 207 is in a raised unlocked position, however, it is understood that the functioning and operation of slider 207 is similar in to that of slider 107.

FIGS. 21 and 22 are front perspective views while FIG. 23 is a rear perspective view of assembly 201. Slider 207 is configured to translate along a surface 209 of equipment cover 205 between a first position and a second position. In the first position, slider 207 is lowered into contact with handle 211, wherein slider 207 is between a portion of handle 211 and cover 205. In this position, handle 211 is prevented from depressing into magnet housing 103 and rotating. In the second position, slider 207 is raised such that there is no interference in the operation of handle 211.

As seen in the Figures, slider 207 includes a slot 213. Assembly 201 includes a set of fasteners 215 configured to secure slider 207 in relation to surface 209 via the head of the fasteners 215, but also to permit translation of fasteners 215 within slot 213. Equipment cover 205 and slider 207 include a plurality of aligned holes 216*a* and 216*b* that are used to facilitate locking of the slider 207 to a particular position, namely either the first and the second positions. Lock 202 passes through holes 216*a* and 216*b*. Of note with FIG. 23 is the internal cavity 217 formed within cover 205 and housing 103. As seen in FIG. 19, control device 85 is a push button device that needs to be depressed to turn on and off. Cover 205 surrounds and covers control device 85 to restrict activation of control device 85.

It is seen that a number of fasteners are used to secure the various parts of assembly 201 together. The fasteners are not meant to be limiting but are exemplary as one method of securing them. Other forms such as interference fit, adhesives, and the sort may also be used.

Figure 24:
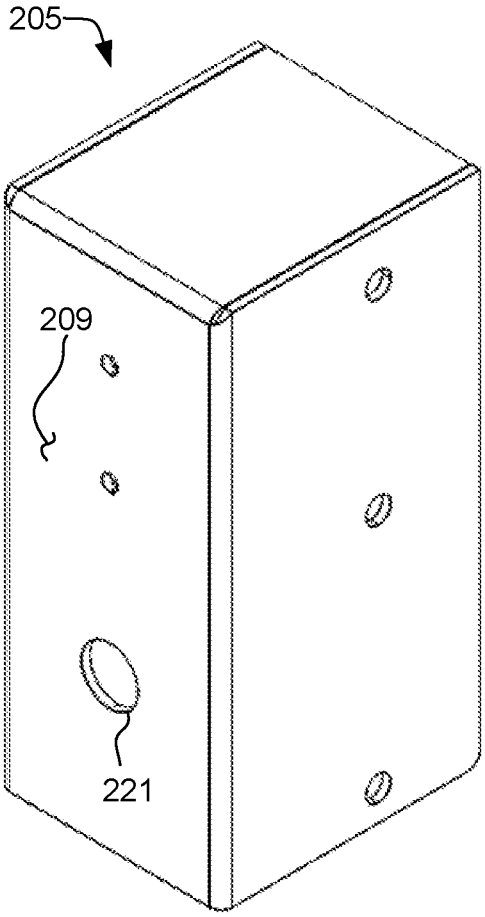
FIGS. 24 and 25 are perspective views of a slide cover in the modular electrical safety assembly of FIG. 21.
Figure 25:
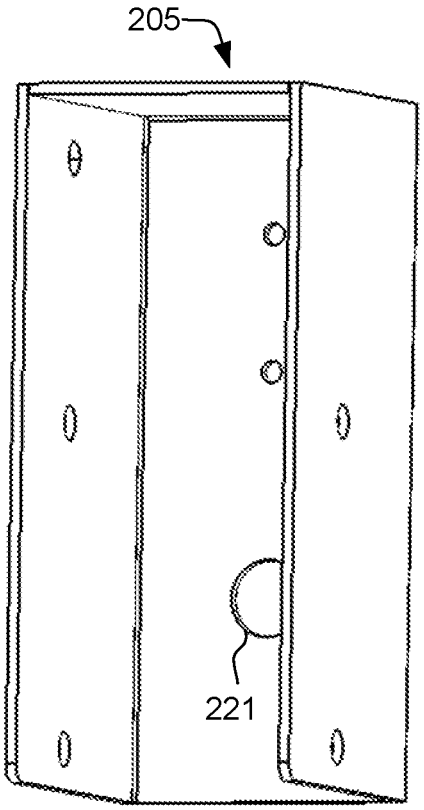

Referring now also to FIGS. 24 and 25 in the drawings, perspective views of equipment cover 205 is illustrated. Cover 205 is configured to surround housing 103 and create cavity 217. Device 85 is configured to pass into cavity 217. Along a front face 209 of cover 205 is an aperture 221 configured to permit handle 211 to pass therethrough and operate the magnet. Above aperture 221 are a plurality of holes to engage fasteners 215. Other holes are used to secure cover to housing 103 and to secure a tab 223.

Figure 26:
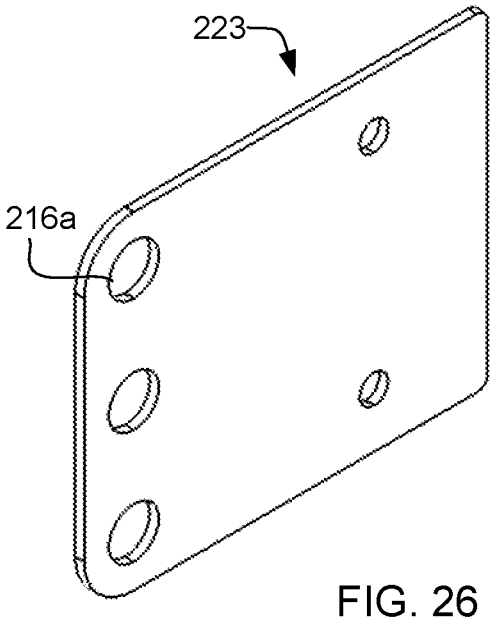
FIG. 26 is a perspective view of a side tap in the modular electrical safety assembly of FIG. 21.

Referring now also to FIG. 26 in the drawings, tab 223 is illustrated. Tab 226 is a part of cover 105 and is fastened to one side thereof. Tab 223 includes a plurality of holes 216*a* for selective alignment with holes 216*b* of slider 207.

Figure 27:
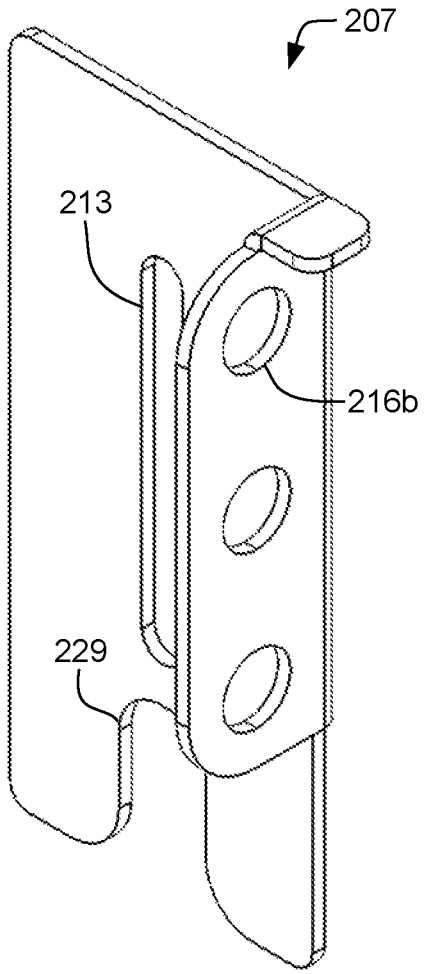
FIGS. 27 and 28 are perspective views of a slider in the modular electrical safety assembly of FIG. 21.
Figure 28:
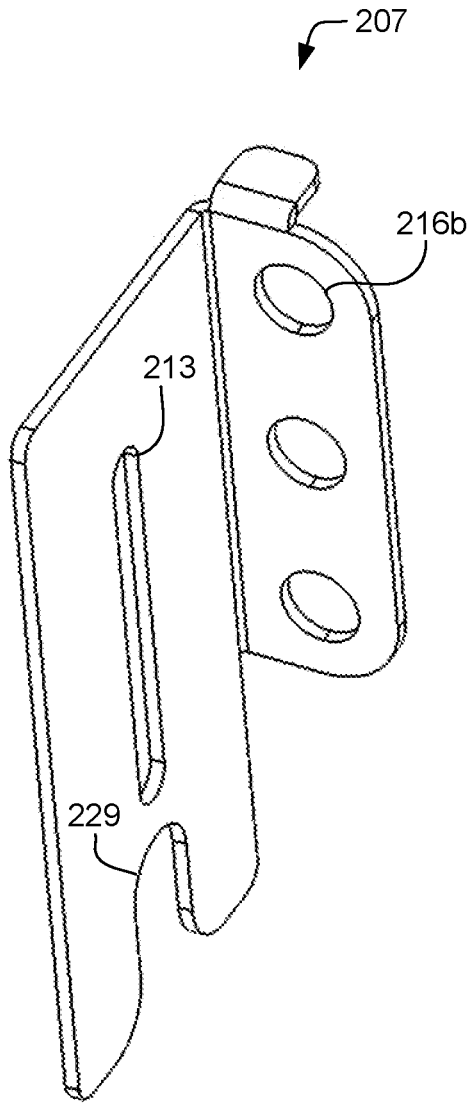

Referring now also to FIGS. 27 and 28 in the drawings, enlarged perspective views of slider 207 are illustrated. Slider 207 includes slot 213 and apertures 216*b* as described previously. Slider 207 is configured to restrict removal of assembly 201 from equipment 89. As assembly 201 uses magnetic attractive forces to create the coupling effect between the two, a method is provided to selectively release or remove the magnetic attraction force. Handle 211 is used as one method of regulating the attraction force. In this embodiment, handle 211 depresses into magnet housing 103 and initiates a movement of the internal magnet. If handle 211 is prevented from depressing into housing 103, the position of the magnet is prevented from changing. Therefore, if the position of the magnet was such as to induce magnetic attraction forces, such forces would stay active until handle 211 was operated to change it. Likewise, if the position of the magnet was such as to remove magnetic attraction forces, such forces would remain removed until handle 211 was operated to change it. Slider 207 includes a saddle arch 229 configured to translate between handle 211 and cover 105 so as to prevent the depression of handle 211 to affect the magnetic attraction forces.

It is understood that the parts of assemblies 101/201 may be made from any materials, such as metal, die cast aluminum, composites, and so forth. Additionally, other manners of actuating or initiating movements of the magnets in the assemblies are known. Assemblies 101/201 are configured to selectively activate or use magnetic attraction to secure a body cover about a control device so as to restrict operation of the control device. In these embodiments, a switchable or rotatable magnet has been described. In this manner assemblies 101/201 are effective temporary magnetic lock-out/tag-out devices.

A method of preventing operation of the control devices during servicing of an electrical equipment can include locating a magnet housing adjacent to a surface of the electrical equipment. The magnet housing being coupled to an equipment cover. Aligning the equipment cover in relation to the control device so as to restrict access sufficient to activate the control device. Coupling the magnet housing to the electrical equipment via a magnet within the housing, the magnet selectively inducing an attraction force on the electrical equipment. The magnet is configured to change polarity to selectively induce and remove the attraction force. Finally, locking the magnet to prevent removal of the attraction force by translating a slider along the equipment cover between a first position and a second position.

The current application has many advantages over the prior art including at least the fact that the assemblies are not permanently mounted to the electrical equipment and may be installed and used on multiple pieces of the same type of electrical equipment quickly and easily. Furthermore, the assemblies do not require any special modifications to the electrical equipment or enclosure.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A modular electrical safety assembly for use with a control device of an electrical equipment, comprising:

a magnet housing including a magnet, the magnet configured to selectively couple to the electrical equipment;

an equipment cover coupled to the magnet housing and configured to prevent operation of the control device; and a slider configured to translate along a surface of the equipment cover between a first position and a second position, the first position prevents coupling and uncoupling of the magnet to the electrical equipment, the second position permits coupling and uncoupling of the magnet to the electrical equipment;

wherein the slider and equipment cover lock together to selectively restrict translation of the slider.

2. The assembly of claim 1, wherein polarity of the magnet is adjustable.

3. The assembly of claim 1, wherein the magnet housing includes a handle configured to change alignment of the magnet.

4. The assembly of claim 3, wherein the slider passes between a portion of the handle and the equipment cover to prevent operation of the handle.

5. The assembly of claim 3, wherein polarity of the magnet is adjustable, the handle selectively aligns the polarity of the magnet to selectively create an attraction force toward the electrical equipment.

6. The assembly of claim 3, wherein the magnet includes a first magnet and a second magnet, the first magnet is fixed in the magnet housing and the second magnet is coupled to the handle, the handle configured to depress into the magnet housing to rotate the second magnet so as to adjust a polarity of the second magnet relative to the first magnet so as to create or remove an attraction force toward the electrical equipment.

7. The assembly of claim 6, wherein the polarity of the second magnet is prevented from changing with the slider in the first position.

8. The assembly of claim 1, wherein the magnet is a switchable magnet configured to alternate its polarity.

9. The assembly of claim 1, wherein the slider and the equipment cover include a plurality of aligned holes to facilitate locking of the slider in at least one of the first position and the second position.

10. The assembly of claim 9, further comprising:

a lock configured to pass through a set of the plurality of aligned holes in the equipment cover and the slider to secure the position of the slider.

11. The assembly of claim 1, wherein the slider includes a slot and a set of fasteners passing therethrough into the equipment cover, the slider translating between positions by sliding the set of fasteners through the slot.

12. The assembly of claim 1, wherein the equipment cover surrounds a portion of the control device to restrict rotation of the control device.

13. The assembly of claim 1, wherein the equipment cover covers a portion of the control device to restrict activation of the control device.

14. The assembly of claim 1, wherein the magnet is configured to couple to the electrical equipment through a magnetic attraction force.

15. The assembly of claim 1, wherein the equipment cover includes a tab, the tab configured to engage a surface of the slider, the tab and the slider having a plurality of aligned holes, the plurality of aligned holes selectively align as the slider translates between the first position and the second position.

16. The assembly of claim 15, further comprising:

a lock configured to pass through a set of the plurality of aligned holes in the tab and the slider to secure the position of the slider.

17. A method of preventing operation of a control device during servicing of an electrical equipment, comprising:

locating a magnet housing adjacent a surface of the electrical equipment, the magnet housing having an equipment cover;

aligning the equipment cover in relation to the control device;

coupling the magnet housing to the electrical equipment via a magnet within the housing, the magnet selectively inducing an attraction force on the electrical equipment; and locking the magnet to prevent removal of the attraction force.

18. The method of claim 17, wherein locking the magnet includes translating a slider along the equipment cover between a first position and a second position.

19. The method of claim 17, wherein the magnet is configured to change polarity to selectively induce and remove the attraction force.

20. The method of claim 17, wherein the equipment cover prevents operation of the control device.

* * * * *